US005549494A

United States Patent [19]

Fosmer

[11] Patent Number: 5,549,494

[45] Date of Patent: Aug. 27, 1996

[54] INBOARD MOTORBOAT ENGINE FLUSHER

[76] Inventor: William F. Fosmer, 1649 Mason Ave., Daytona Beach, Fla. 32117

[21] Appl. No.: 491,384

[22] Filed: Jun. 16, 1995

[51] Int. Cl.[6] ..... B08B 9/00

[52] U.S. Cl. ..... 440/88; 440/113

[58] Field of Search ..... 440/88, 113, 900; 114/221 R, 222; 134/167 R, 169 A, 199

[56] References Cited

U.S. PATENT DOCUMENTS

| | | | |
|---|---|---|---|
| 3,135,233 | 6/1964 | Looker | 440/113 |
| 3,347,202 | 10/1967 | McMurry | 440/113 |
| 3,500,786 | 3/1970 | Oliver | 440/88 |
| 3,931,828 | 1/1976 | Lawler | 134/167 R |
| 4,052,953 | 10/1977 | Patel | 440/88 |
| 4,065,325 | 12/1977 | Maloney | 134/167 R |
| 4,589,851 | 5/1986 | Karls | 440/88 |
| 4,729,393 | 3/1988 | Ferguson | 134/167 R |
| 5,051,104 | 9/1991 | Guhlin | 440/88 |
| 5,071,377 | 12/1991 | Saunders et al. | 440/88 |
| 5,137,482 | 8/1992 | Hull et al. | 440/88 |
| 5,362,265 | 11/1994 | Gervais | 440/88 |

FOREIGN PATENT DOCUMENTS 62-251296 11/1987 Japan .

*Primary Examiner*—Jesus D. Sotelo

*Attorney, Agent, or Firm*—Edward M. Livingston, Esq.

[57] ABSTRACT

An inboard-motorboat-engine flusher has an inlet enclosure (1) with a means for attachment (5, 6, 11, 16) to a bottom (3) of a boat (4), a conduit (7) in fluid communication between an outside and an inside of the inlet enclosure, and a hose connector (8) on the conduit.

9 Claims, 2 Drawing Sheets

FIG. 1
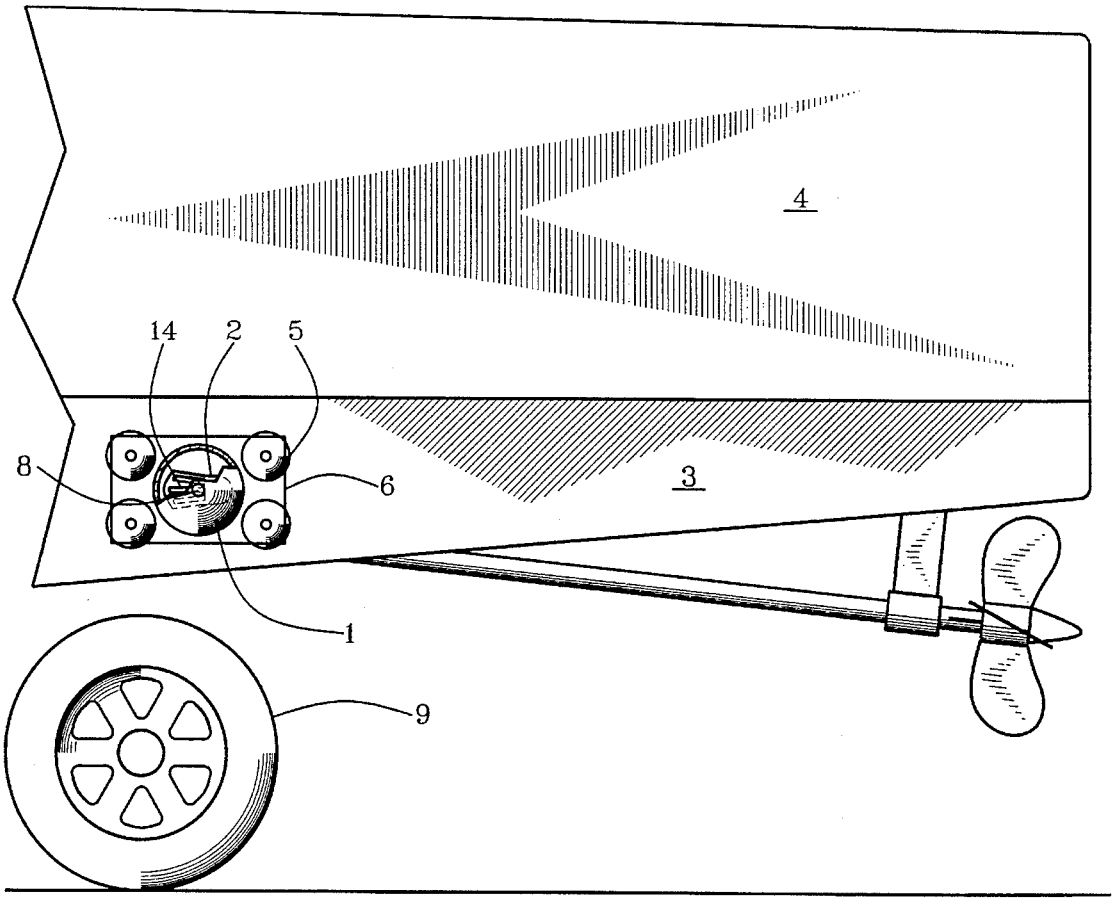
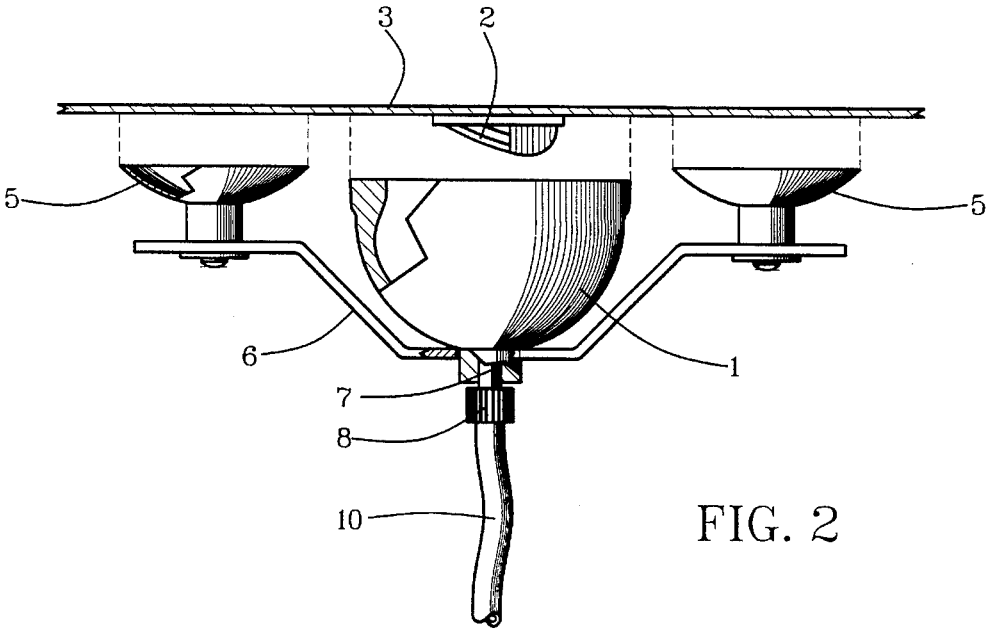
FIG. 2

INBOARD MOTORBOAT ENGINE FLUSHER

BACKGROUND OF THE INVENTION

This invention relates to supplying inboard motorboat engines with hose water to purge them of salt water, harmful debris and chemicals and to run them for testing, demonstration and repair purposes. More particularly, it relates to a means for maintaining a water hose in fluid communication with an engine-water inlet port on a bottom of a boat that is positioned on a trailer or other support out of water.

An inboard engine in an inboard motorboat is cooled with water taken in through an inlet port in a bottom of its hull. When the inboard motorboat is out of water, it is often necessary to run its inboard engine, either to demonstrate it for sales, to purge it of salt water or harmful debris after it has been operated, or for purposes related to repair and maintenance of the inboard engine. The most practical source of water is a water hose in fluid communication with the inlet port.

At present, although there are many flushing devices for holding a hose in fluid communication with an outboard engine, there are no known practical means for typical boaters, sales personnel or repair personnel to maintain a water hose in contact with the inlet port while water is being run through an engine of an inboard motorboat that is out of water on a trailer or other support. Most owners of inboard motor boats try to hold a hose to the inlet port which gets them soaked while doing so and is very insufficient. In the prior patented art only two are known and they both require a ground-supported pillar and a special water connector. One is described in U.S. Pat. No. 5,137,482, issued to Hull, et al. on Aug. 11, 1992. The other is described in U.S. Pat. No. 5,071,377, issued to Saunders, et al. on Dec. 10, 1991. A person desiring to run hose water through an inboard engine out of water generally finds it easier to hold the hose by hand and get all wet doing it than to use either the Hull, et al. or the Saunders, et al. pillar-supported devices.

SUMMARY OF THE INVENTION

In light of problems that have existed and that continue to exist in this field, objectives of this invention are to provide an inboard-motorboat-engine flusher which:

Can be attached quickly and easily to a boat bottom;

Provides reliable fluid communication between a water hose and a cooling-water inlet port;

Is light and small for being carried easily and for being stored;

Has a standard hose connection; and

Is inexpensive and durable.

This invention accomplishes the above and other objectives with an inboard-motorboat-engine flusher having an inlet enclosure with a means for attachment to a bottom of a boat, a conduit in fluid communication between an outside and an inside of the inlet enclosure, and a hose connector on the conduit.

The above and other objects, features and advantages of the present invention will become apparent to those skilled in the art upon a reading of the following detailed description when taken in conjunction with the drawings wherein there is shown and described an illustrative embodiment of the invention.

BRIEF DESCRIPTION OF DRAWINGS

This invention is described by appended claims in relation to description of a preferred embodiment with reference to the following drawings which are described briefly as follows:

FIG. 1 is a partially cutaway fragmentary side view of a rear end of an inboard-engine motorboat to which this inboard-motorboat-engine flusher is attached with suction cups;

FIG. 2 is a partially cutaway fragmentary view of the flusher shown in relationship to a bottom of a boat;

DESCRIPTION OF PREFERRED EMBODIMENT

Figure 3:
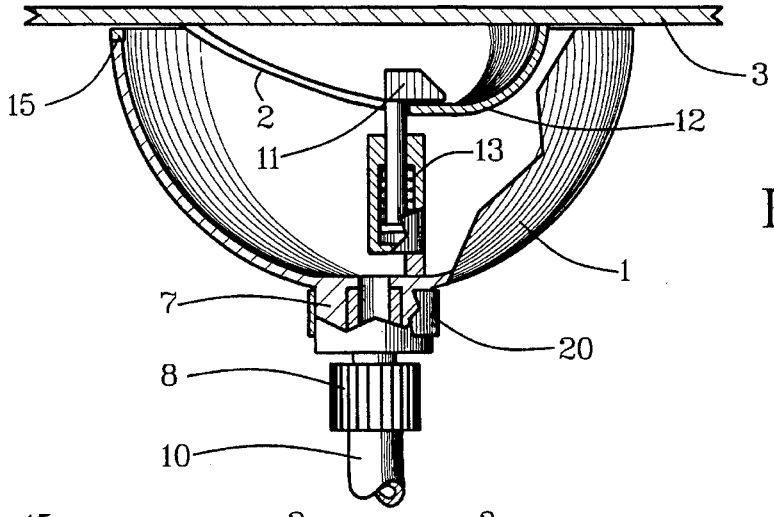
FIG. 3 is a partially cutaway side view of a cooling-water-inlet enclosure with an inlet hook as an enclosure holder.

Reference is made first to FIGS. 1–2. A cooling-water-inlet enclosure 1 is designedly water-tight and sized and shaped to fit over a cooling-water inlet 2 on a bottom 3 of an inboard-engine motorboat 4. An enclosure holder can be a plurality of suction cups, such as but not necessarily, resilient suction cups 5 attached to a bracket 6 on the cooling-water-inlet enclosure 1 for holding the cooling-water-inlet enclosure 1 in designedly water-tight contact with the bottom 3 of the inboard-engine motorboat 4 about the cooling-water inlet 2.

A conduit 7 having a hose connector 8 is in fluid communication between an outside periphery and an inside periphery of the cooling-water-inlet enclosure 1 and the hose connector 8 is in fluid communication with the conduit 7. The hose connector 8 is attachable to a typical garden hose 10 for supplying water at the cooling-water inlet 2 for flushing a cooling system of such engine as may be in the inboard-engine motorboat 4 when the resilient suction cups 5 are in suction attachment to the bottom 3 of the inboard-engine motorboat 4. This allows a person to run the engine for reasons such as demonstration of operativeness, testing and flushing out salt water, harmful chemical substances and debris that may have entered the cooling system of the engine when being operated on a body of water.

Use of this inboard-motorboat-engine flusher is accomplished when the inboard-engine motorboat 4 is out of the water and positioned on a platform, a stand or most generally, a trailer represented figuratively by wheel 9. Without this inboard-motorboat-engine flusher, an owner or user of a boat is obliged to get all wet holding the hose 10 with some makeshift contraption or using some of the less convenient devices that are known.

The cooling-water-inlet enclosure 1 can be a standard hemispherical toilet-plunger bulb or its equivalent. The bracket 6 can be a sheet of transparent plastic with a truncate center such as depicted in FIG. 2. In FIG. 1, the resilient suction cups 5 are visible through the bracket 6 because of its transparency. Also in FIG. 1, the complete flusher is shown as though on a vertical or flat surface, rather than on a slanted surface for clarity.

In FIG. 2, the cooling-water-inlet enclosure 1 is shown slightly recessed from the resilient suction cups 5. This allows the suction cups 5 to be depressed in suction mode without resistance by the cooling-water-inlet enclosure 1 when pushed against a bottom 3. Designedly, the resilient suction cups 5 and the cooling-water-inlet enclosure 1 will be in contact with the bottom 3 in a planar relationship.

A plurality of four resilient suction cups 5 are shown in this preferred embodiment. There can be more or less, however, provided the bracket 6 is structured accordingly. For instance, if a circular bracket 6 with a truncate-conical center portion for the cooling-water-inlet enclosure 1 is used, three, five or other plurality of resilient suction cups 5 can be employed. Three might be desirable for some bottoms 3 with irregular surfaces.

The resilient suction cups 5 and bracket 6 are the most preferred enclosure holder because they are so easy to just slap on and use. Some boat bottoms 3, however, are not smooth enough for suction sealing of the resilient suction cups 5. Other bottom surfaces are not sufficiently flat. For these and other bottom configurations, the enclosure holder can be different as described in relation to FIGS. 3–5.

Referring to FIG. 3, the enclosure holder can be an inlet hook 11 that is attached to an inside periphery of the cooling-water-inlet enclosure 1 and hooked onto an inside periphery of an inlet screen 12 of the cooling-water inlet 2. A hook spring 13 can be employed to maintain the cooling-water-inlet enclosure 1 in designedly water-sealing relationship with the bottom 3 of the inboard-engine motorboat 4 while flushing water is directed into the cooling-water inlet 2 from a hose 10 attached to the hose connector 8.

Most cooling-water inlets 2 have a quarter-spherical front section with an inside periphery of the inlet screen 12 to which the inlet hook 11 can be hooked. Also, most cooling-water inlets 2 are sturdy enough for attachment of the inlet hook 11. The inlet hook 11 is inserted through an inlet orifice 14 of a cooling-water inlet 2 and positioned with the inlet hook 11 facing rearward in an opposite direction from a plurality of inlet orifices 14. Inlet orifices 14 are shown in FIGS. 1 and 4.

The cooling-water-inlet enclosure 1 need not be a toilet plunger. It can be thin-walled as depicted in FIGS. 3–4. For some types of walls of the cooling-water-inlet enclosure 1, a resilient seal 15 can be positioned on a contact surface of the cooling-water-inlet enclosure 1.

Figure 4:
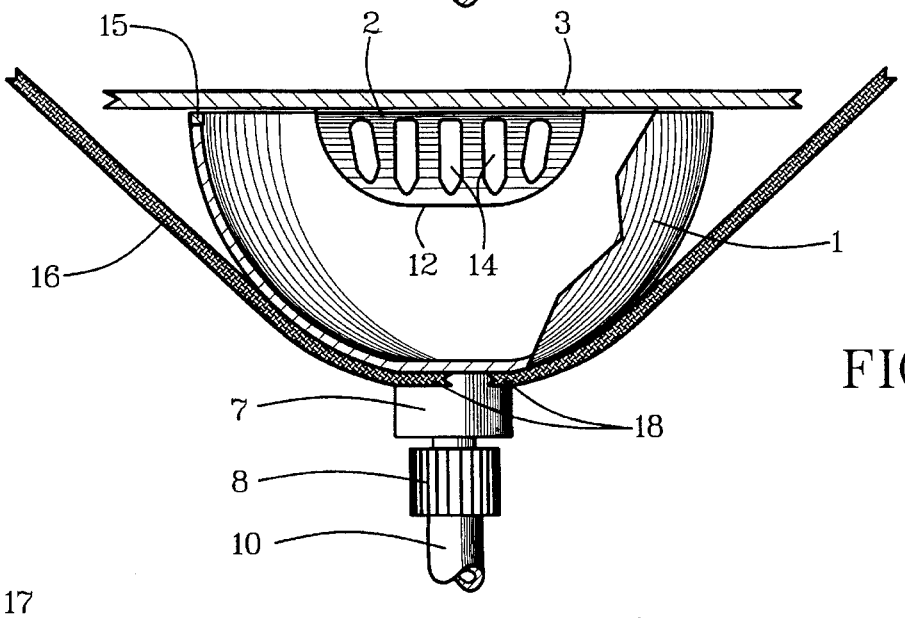
FIG. 4 is a partially cutaway side view of a cooling-water-inlet enclosure with a suspender as an enclosure holder.
Figure 5:
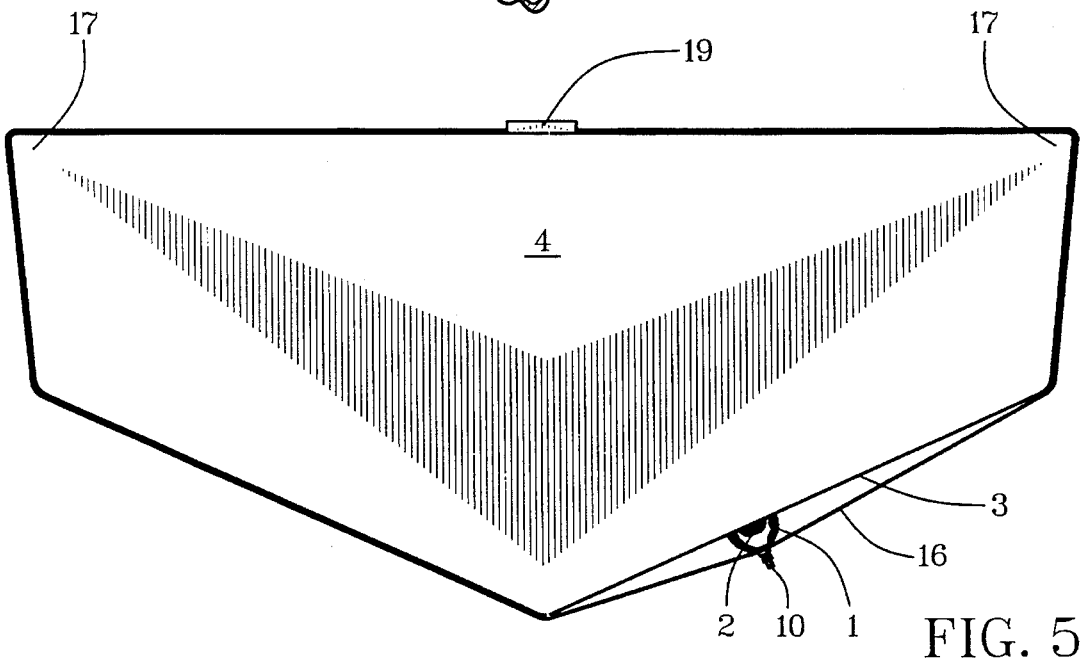
FIG. 5 is a configurational form of an inboard-engine motorboat at a position where a cooling-water-inlet enclosure is attached with the suspender.

Referring to FIGS. 4–5, the enclosure holder can be a suspender 16 that is suspended from opposite-side portions 17 of the inboard-engine motorboat 4 that are higher than the cooling-water inlet 2. The suspender 16 can be wrapped around the inboard-engine motorboat 4 or attached to corners which are opposite-side portions 17 that are higher than the cooling-water inlet 2. The suspenders 16 can be straps or lines as desired. The suspender 16 can have a harness portion 18 which wraps around or variously encloses a conduit 7 appendage or conduit area of the cooling-water-inlet enclosure 1. An attachment buckle 19 can be positioned centrally as shown or on the opposite-side portions 17, depending on how the suspender 16 is attached to the boat 4.

Referring further to FIG. 3, a hose clamp 20 of various types can be used to attach the hose connector 8 to a conduit 7 that is an appendage of the cooling-water-inlet enclosure 1.

A new and useful inboard-motorboat-engine flusher having been described, all such modifications, adaptations, substitutions of equivalents, combinations of parts, applications and forms thereof as described by the following claims are included in this invention.

I claim:

1. An inboard-motorboat-engine flusher comprising:

a cooling-water-inlet enclosure that is designedly water-tight and sized and shaped to fit over a cooling-water inlet on a bottom of an inboard-engine motorboat;

an enclosure holder for holding the cooling-water-inlet enclosure in designedly water-tight contact with the bottom of the inboard-engine motorboat about the cooling-water inlet wherein the enclosure holder is a plurality of resilient suction cups attached to a bracket on the cooling-water-inlet enclosure, said suction cups being positioned for suction attachment to the bottom of the inboard-engine motorboat;

a conduit in fluid communication between an outside periphery of the cooling-water-inlet enclosure and an inside periphery of the cooling-water-inlet enclosure;

a hose connector having a hose-connection means on an outside periphery of the cooling-water-inlet enclosure; and the hose connector being in fluid communication with the conduit.

2. An inboard-motorboat-engine flusher as described in claim 1 wherein:

the cooling-water-inlet enclosure is made of designedly resilient material.

3. An inboard-motorboat-engine flusher as described in claim 1 wherein:

the cooling-water-inlet enclosure is made of designedly rigid material having a designedly resilient seal on a boat-contact surface of the cooling-water-inlet enclosure.

4. An inboard-motorboat-engine flusher comprising:

a cooling-water-inlet enclosure that is designedly water-tight and sized and shaped to fit over a cooling water inlet on a bottom of an inboard-engine motorboat;

an enclosure holder for holding the cooling-water-inlet enclosure in designedly water-tight contact with the bottom of the inboard-engine motorboat about the cooling-water inlet;

a conduit in fluid communication between an outside periphery of the cooling-water-inlet enclosure and an inside periphery of the cooling-water-inlet enclosure;

a hose connector having a hose-connection means on an outside periphery of the cooling-water-inlet enclosure;

the hose connector being in fluid communication with the conduit;

wherein the enclosure holder is a suspender that is suspended from opposite-side portions of the inboard-engine motorboat that are higher on the inboard-engine motorboat than the cooling-water inlet;

the suspender is extended to the cooling-water-inlet enclosure; and the suspender is attached to the cooling-water-inlet enclosure, such that the cooling-water-inlet enclosure is maintained in contact with the bottom of the outboard-engine motorboat while water is directed into the cooling-water inlet through the conduit from a hose attached to the hose connector.

5. An inboard-motorboat-engine flusher as described in claim 4 wherein:

the cooling-water-inlet enclosure is made of designedly resilient material.

6. An inboard-motorboat-engine flusher as described in claim 4 wherein:

the cooling-water-inlet enclosure is made of designedly rigid material having a designedly resilient seal on a boat-contact surface of the cooling-water-inlet enclosure.

7. An inboard-motorboat-engine flusher as described in claim 4 wherein:

the suspender is made of a resilient fibrous material.

8. An inboard-motorboat-engine flusher as described in claim 7 wherein:

the suspender has a rectangular configuration, such that the suspender is a pair of straps extended from the cooling-water-inlet enclosure to the opposite-side portions of the inboard-engine motorboat.

9. An inboard-motorboat-engine flusher as described in claim 7 wherein:

the suspender has a circular configuration, such that the suspender is a pair of lines extended from the cooling-water-inlet enclosure to the opposite-side portions of the inboard-engine motorboat.

* * * * *